US010758769B2

(12) United States Patent
Aihara

(10) Patent No.: US 10,758,769 B2
(45) Date of Patent: Sep. 1, 2020

(54) EXERCISE LOOPS

(71) Applicant: Kazuko Aihara, Toyohashi (JP)

(72) Inventor: Kazuko Aihara, Toyohashi (JP)

( * ) Notice: Subject to any disclaimer, the term of this patent is extended or adjusted under 35 U.S.C. 154(b) by 113 days.

(21) Appl. No.: 16/089,577

(22) PCT Filed: Mar. 27, 2017

(86) PCT No.: PCT/JP2017/012220
§ 371 (c)(1),
(2) Date: Sep. 28, 2018

(87) PCT Pub. No.: WO2017/170308
PCT Pub. Date: Oct. 5, 2017

(65) Prior Publication Data

US 2019/0111303 A1 Apr. 18, 2019

(30) Foreign Application Priority Data

Mar. 29, 2016 (JP) ..... 2016-001415

(51) Int. Cl.
*A63B 21/055* (2006.01)
*A63B 21/02* (2006.01)
*A63B 21/00* (2006.01)

(52) U.S. Cl.
CPC ..... *A63B 21/055* (2013.01); *A63B 21/02* (2013.01); *A63B 21/4035* (2015.10)

(58) Field of Classification Search
CPC .... A63B 5/00; A63B 5/16; A63B 5/20; A63B 5/22; A63B 21/0004; A63B 21/00043; A63B 21/00058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552;
(Continued)

(56) References Cited

U.S. PATENT DOCUMENTS 1,663,641 A * 3/1928 Smallwood ..... A63B 21/0004 482/124
3,075,767 A * 1/1963 Ono ..... A63B 5/20 482/82

(Continued)

FOREIGN PATENT DOCUMENTS

JP S63130069 U 8/1988
JP 2003-144576 A 5/2003
JP 3094822 U 7/2003

*Primary Examiner* — Gary D Urbiel Goldner
(74) *Attorney, Agent, or Firm* — Muncy, Geissler, Olds & Lowe, P.C.

(57) ABSTRACT

Exercise loops (1) comprise a first loop (2), a second loop (3), and a third loop (4) each formed by joining opposite ends of an elastic elongated member into a ring shape, wherein the first loop (2) and the third loop (4) are each connected so as to be interlocked with the second loop (3). The first loop (2) and the third loop (4) preferably comprise fasteners (2*b*, 4*b*) that secure engagement parts engaged with the second loop (3) and that are movable along the elongated members. The first loop (2) and the third loop (4) can be connected so as to be interlocked with each other.

8 Claims, 3 Drawing Sheets

(58) Field of Classification Search
CPC ..... A63B 21/0555; A63B 21/0557; A63B 21/065; A63B 21/068; A63B 21/08; A63B 21/15; A63B 21/151; A63B 21/4011; A63B 21/4013; A63B 21/4015; A63B 21/4017; A63B 21/4019; A63B 21/4021; A63B 21/4023; A63B 21/4025; A63B 21/4027; A63B 21/4033; A63B 21/4034; A63B 21/4035; A63B 21/4041; A63B 21/4043; A63B 21/4045; A63B 69/0057; A63B 69/0059; A63B 2069/0062; A63B 71/0054; A63B 2071/0063; A63B 2071/0072; A63B 2209/00; A63B 2225/09; A63B 2225/093
See application file for complete search history.

(56) References Cited

U.S. PATENT DOCUMENTS 3,529,820 A * 9/1970 Templeton ..... A63B 21/0552 482/122
4,033,580 A * 7/1977 Paris ..... A63B 21/0004 482/122
4,121,827 A * 10/1978 Weider ..... A63B 21/0004 482/125
5,318,494 A * 6/1994 Santighian ..... A63B 21/0004 482/121
5,518,481 A * 5/1996 Darkwah ..... A63B 21/0004 482/126
5,614,300 A 3/1997 Cicali et al.
5,723,785 A * 3/1998 Manning ..... A61B 5/1107 482/48
6,071,218 A * 6/2000 Tepperberg ..... A63B 21/0004 482/121
6,213,918 B1 * 4/2001 Rogers, Jr. ..... A63B 21/0004 482/124
6,368,255 B1 * 4/2002 Chan-Rouse ..... A63B 23/00 482/126
6,817,967 B1 * 11/2004 Ott ..... A63B 21/0004 482/47
8,771,155 B1 * 7/2014 Bell ..... A63B 69/0059 482/124
8,845,444 B1 * 9/2014 Hoang ..... A63B 69/3608 473/208
9,302,137 B1 * 4/2016 Yelvington ..... A61F 13/061
9,446,279 B1 * 9/2016 Yelvington ..... A63B 21/0552
9,610,471 B1 * 4/2017 Langlois ..... A63B 21/0552
10,124,204 B1 * 11/2018 Vo ..... A63B 21/0407
2004/0152569 A1 * 8/2004 Lerner ..... A63B 21/0552 482/124
2007/0129216 A1 * 6/2007 Ott ..... A63B 21/055 482/48
2011/0306477 A1 * 12/2011 Keen ..... A63B 21/02 482/122
2013/0331242 A1 * 12/2013 Wilson ..... A63B 21/0004 482/126
2014/0051549 A1 * 2/2014 Hunter ..... A63B 7/02 482/24
2014/0357458 A1 * 12/2014 Callanan ..... A63B 21/02 482/129
2014/0371039 A1 * 12/2014 Burrell ..... A63B 21/00043 482/124
2015/0005141 A1 * 1/2015 Krahling ..... A63B 21/0442 482/124
2015/0024910 A1 * 1/2015 Natee ..... A63B 9/00 482/122
2015/0141217 A1 * 5/2015 Young ..... A63B 21/0442 482/126
2016/0206914 A1 * 7/2016 Zaki ..... A63B 21/0552
2016/0287927 A1 * 10/2016 Hunter ..... A63B 21/4035

* cited by examiner

EXERCISE LOOPS

TECHNICAL FIELD

The present invention relates to exercise loops with which training can be carried out by utilizing the elasticity of the loop.

BACKGROUND ART

Ring-shaped exercise loops made of an elastic material such as rubber have been used in muscle training and stretching. Unlike training that utilizes one's own weight as in weight training, training involving an exercise loop not only inhibits the use of inertia or bouncing, but also is capable of imparting a load to various planes (e.g., the sagittal plane, frontal plane, and transverse plane) of a human body, and therefore effective training can be carried out. As for a conventional exercise tool, Patent Literature 1 discloses a fitness tool wherein four ring-shaped rubber members are securely held at one place by a bundling member.

CITATION LIST

Patent Literature

Patent Literature 1: JP 2003-144576A

SUMMARY OF INVENTION

Technical Problem

When a plurality of ring-shaped rubber members are provided as in the above-described conventional exercise tool, stretch resistance can be increased by placing the ring-shaped rubber members one on top of the other, and thus the potential users and the type of training can be increased extensively.

However, the above-described conventional exercise tool is problematic in that the ring-shaped rubber members are securely held by the bundling member, so the bundling member becomes an obstacle when placing the ring-shaped rubber members one on top of the other, thus making it difficult to use the exercise tool.

Accordingly, an object of the present invention is to provide exercise loops that allow exercise intensity to be easily adjusted, enables various exercises, and has excellent portability and handleability as well.

Solution to Problem

The object of the present invention is achieved by exercise loops comprising a first loop, a second loop, and a third loop each formed by joining opposite ends of an elastic elongated member into a ring shape, wherein the first loop and the third loop are each connected so as to be interlocked with the second loop.

In this exercise loops, it is preferable that the first loop and the third loop each comprise a fastener that secures an engagement part engaged with the second loop and that is movable along the elongated member.

It is preferable that the first loop and the third loop are connected so as to be interlocked with each other. In this configuration, it is preferable that the exercise loops further comprise a fourth loop and a fifth loop each formed by joining opposite ends of an elastic elongated member into a ring shape. It is preferable that the fourth loop and the fifth loop are connected so as to be interlocked with each other and are also each connected so as to be interlocked with the second loop. The exercise loops can be configured such that stretch resistances are mutually different between the first loop and the third loop and between the fourth loop and the fifth loop.

Advantageous Effects of Invention

The present invention can provide exercise loops that allow exercise intensity to be easily adjusted, enables various exercises, and has excellent portability and handleability as well.

DESCRIPTION OF EMBODIMENTS

Figure 1:
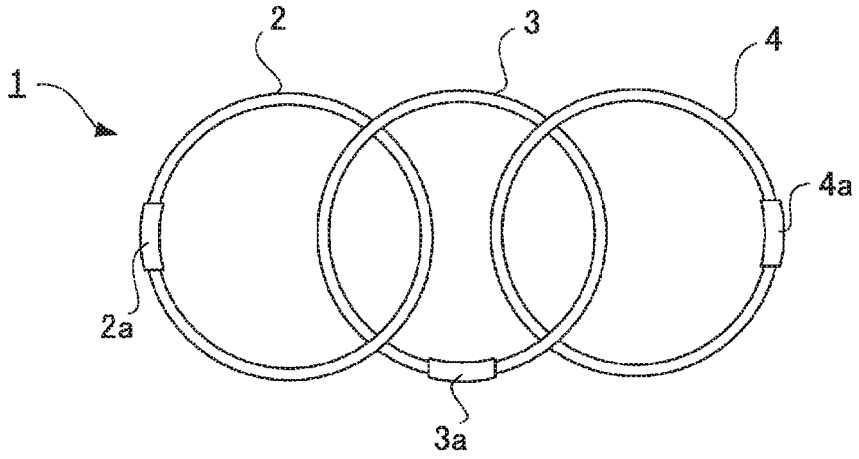
FIG. 1 is a plan view showing exercise loops according to one embodiment of the present invention.

Below, one embodiment of the present invention will now be described with reference to the attached drawings. FIG. 1 is a plan view showing exercise loops according to one embodiment of the present invention. As shown in FIG. 1, exercise loops 1 are formed by connecting a first loop 2, a second loop 3, and a third loop 4.

The first loop 2, the second loop 3, and the third loop 4 are each formed by joining opposite ends of an elongated member, such as a string, a tube, or a belt, that is made of a stretchable material such as a rubber material or a spring material into a ring shape, and a pad or the like is wound around the joined parts to provide grips 2*a*, 3*a*, and 4*a*. As for the first loop 2 and the third loop 4, the elongated members are inserted into the second loop 3, and are thus each connected so as to be interlocked with the second loop 3. The grips 2*a*, 3*a*, and 4*a* are not essential, and the exercise loops may be configured without providing the grips 2*a*, 3*a*, and 4*a* such that a user may grip any part of the elongated members.

It is preferable to set the first loop 2, the second loop 3, and the third loop 4 to have the same length. The first loop 2, the second loop 3, and the third loop 4 preferably have a flexible shape so as to be easily deformed, but may have a (mite shape such as a circle or an ellipse.

According to the exercise loops 1 having the above-described configuration, the first loop 2 and the third loop 4 are connected to the second loop 3 and integrated into a single body, and thus the exercise loops have excellent portability and handleability. When using the exercise loops, training and stretching can be carried out as with the commonly used exercise loops by using any of the first loop 2, the second loop 3, and the third loop 4 singly.

Moreover, in the exercise loops 1 of the present embodiment, the first loop 2 and the third loop 4 are each connected so as to be movable relative to the second loop 3, and it is thus easy to form a double loop or a triple loop by placing them one on top of the other. Accordingly, exercise intensity can be easily adjusted by increasing the stretch resistance (the tension required for obtaining a specific elongation rate) of the exercise loops to the desired extent, and a variety of training activities can be carried out. Also, the positions of the first loop 2 and the third loop 4 relative to the second loop 3 can be easily adjusted, and thus training in accordance with the body height, the body shape, and the like can be suitably carried out.

For example, the exercise loops 1 are used in a double-loop or triple-loop form to carry out muscle contraction against high stretch resistance, then the stretch resistance of the exercise loops 1 is reduced to carry out a stretch exercise, and thus it is possible to use the exercise loops to increase the muscle length and the range of movement of a joint and also use it as an assisting tool for a stretch program.

A low-resistance load that cannot be provided by a training machine can be provided, and thus training of a body part whose range of movement is small can be carried out. On the other hand, training involving high exercise intensity is possible, and therefore the exercise loops can be utilized by a broad range of people including young people, elderly people, and those other than generally healthy people.

By adjusting stretch resistance, the exercise loops can be used for various purposes such as power, agility, and speed, and thus movements that are characteristic of a sporting event can be easily simulated so as to condition the muscle balance and increase muscle strength and muscle endurance. Accordingly, an increase of performance level and disability prevention can be achieved.

In the exercise loops 1 of the present embodiment, the first loop 2, the second loop 3, and the third loop 4 are all set to have the same stretch resistance, but each can be set to have different stretch resistances by changing the material, thickness, and the like. In this case, by selecting a suitable double-loop combination, exercise intensity can be finely adjusted.

Figure 2:
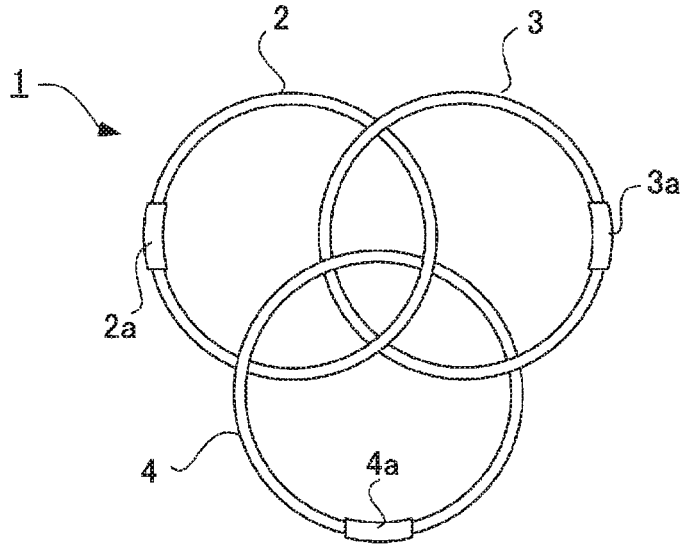
FIG. 2 is a plan view showing exercise loops according to another embodiment of the present invention.

In the exercise loops 1 of the present embodiment, as shown in FIG. 1, the third loop 4 is interlocked only with the second loop 3 and not interlocked with the first loop 2, but as shown in FIG. 2, the third loop 4 may be interlocked with both the first loop 2 and the second loop 3. In addition to enabling the same exercises to be carried out as those carried with the exercise loops 1 shown in FIG. 1, this configuration makes it easier to form a double loop or a triple loop by combining the third loop 4 with one or both of the first loop 2 and the second loop 3, and the desired training can be efficiently carried out.

Figure 3:
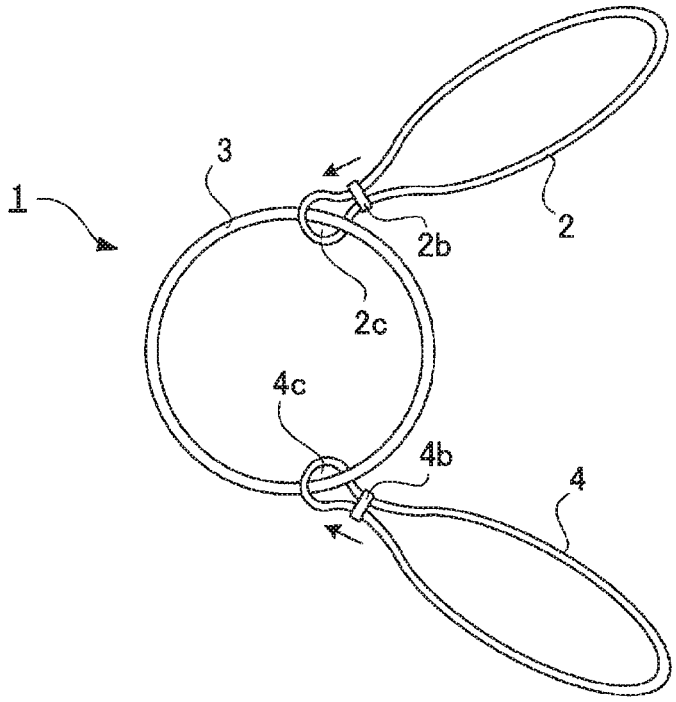
FIG. 3 is a plan view showing exercise loops according to yet another embodiment of the present invention.

As shown in FIG. 3, fasteners 2*b* and 4*b* may be respectively provided on the first loop 2 and the third loop 4 each composed of an elongated member such as a string. The fasteners 2*b*, 4*b* are composed of belt-like hook-and-loop fasteners and are wound around the elongated members so as to form ring-shaped interlocking parts 2*c*, 4*c* on portions of the first loop 2 and the third loop 4.

According to the configuration shown in FIG. 3, sliding the fasteners 2*b*, 4*b* along the elongated members as indicated by the arrows to reduce the sizes of the interlocking parts 2*c*, 4*c* makes it possible to secure the engagement parts of the first loop 2 and the third loop 4 to the second loop 3, thus a suitable exercise can be effectively carried out (for example, a whole body exercise carried out with the second loop 3 looping around the neck of a user and the first loop 2 and the third loop 4 respectively looping around the right and left foot), and the variation of exercises can be increased. Moreover, by securing the first loop 2 and the third loop 4 to the second loop 3, the elongated members can be effectively prevented from being entangled with each other.

On the other hand, sliding the fasteners 2*b*, 4*b* in the directions opposite to the arrows to enlarge the interlocking parts 2*c*, 4*c* makes the first loop 2 and the third loop 4 smoothly movable along the second loop 3, and the same exercises as those carried out with the exercise loops 1 shown in FIG. 1 can be carried out. In this case, the sizes of the first loop 2 and the third loop 4 are also changed due to the movement of the fasteners 2*b*, 4*b*, and thus can be suitably adjusted in accordance with the body height, the body shape, and the like.

As for the fasteners 2*b*, 4*b*, various known configurations can be employed as long as the engaging parts of the first loop 2 and the third loop 4 are reliably secured to the second loop 3. It is preferable that the fasteners 2*b*, 4*b* are capable of adjusting the sizes of the interlocking parts 2*c*, 4*c* by being slid along the elongated members. Other than the belts as in the present embodiment, the fasteners 2*b*, 4*b* may be rings, cylinders, buckles, or the like.

Figure 4:
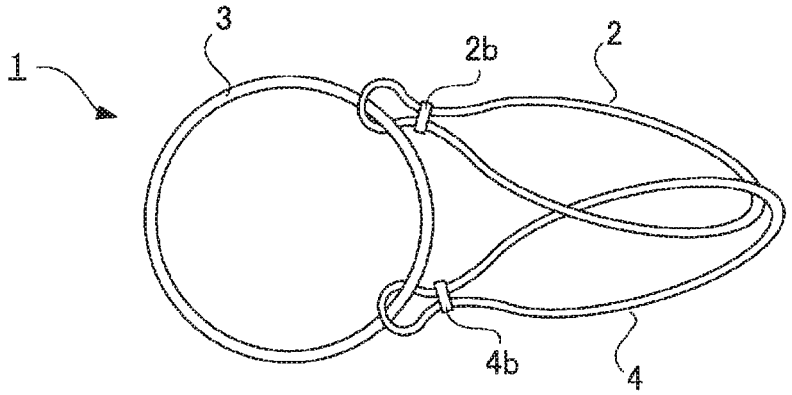
FIG. 4 is a plan view showing exercise loops according to yet another embodiment of the present invention.

The exercise loops 1 shown in FIG. 3 may be configured such that the first loop 2 and the third loop 4 are connected so as to be interlocked with each other as shown in FIG. 4. According to this configuration, in addition to enabling the same exercises to be carried out as those carried out with the exercise loops 1 shown in FIG. 3, the first loop 2 and the third loop 4 can be easily placed one on top of the other or separated from each other, for example, during exercises. Moreover, mutual entanglement of the elongated members can be more reliably prevented.

Figure 5:
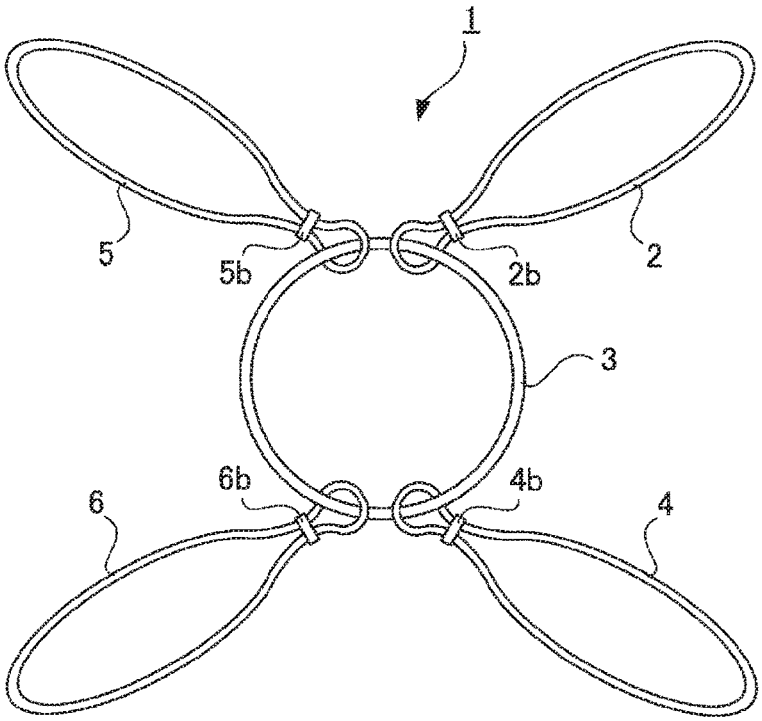
FIG. 5 is a plan view showing exercise loops according to yet another embodiment of the present invention.

The exercise loops 1 shown in FIG. 3 may be configured to further include a fourth loop 5 and a fifth loop 6 as shown in FIG. 5. As with the first loop 2 and the third loop 4, the fourth loop 5 and the fifth loop 6 are each formed by joining the opposite ends of an elastic elongated member into a ring shape, are connected so as to be interlocked with the second loop 3, and include fasteners 5*b* and 6*b* for being secured to the second loop 3.

According to the exercise loops 1 shown in FIG. 5, an exercise can be carried out by, for example, looping the second loop 3 around the neck of a user, looping the first loop 2 and the third loop 4 respectively around the right and left foot, and gripping the fourth loop 5 and the fifth loop 6 respectively by the right and left hands, and thus a whole body exercise can be more effectively carried out.

Figure 6:
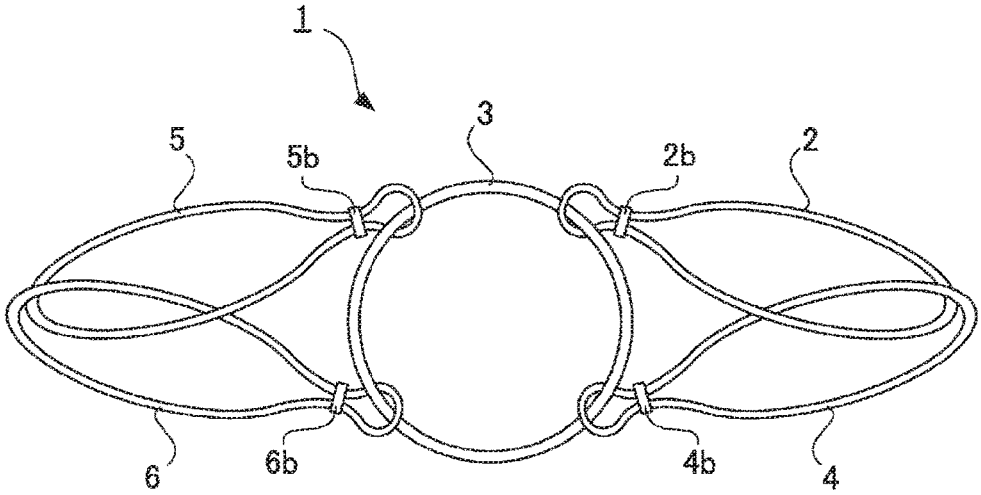
FIG. 6 is a plan view showing exercise loops according to yet another embodiment of the present invention.

The exercise loops 1 shown in FIG. 5 may be configured such that the first loop 2 and the third loop 4 are connected so as to be interlocked with each other, and the fourth loop 5 and the fifth loop 6 are connected so as to be interlocked with each other as shown in FIG. 6. According to this configuration, in addition to enabling the same exercises to be carried out as those carried out with the exercise loops 1 shown in FIG. 5, the loops can be easily placed one on top of the other or separated from each other, and mutual entanglement of the elongated members can be prevented.

The exercise loops 1 shown in FIG. 6 may be configured such that the stretch resistances are mutually different between the first loop 2 and the third loop 4 and between the fourth loop 5 and the fifth loop 6, and by selectively using the loops, exercise intensity can be easily adjusted. Also, in the exercise loops 1 shown in FIGS. 1 to 6, the second loop 3 may be in a multi-loop form composed of two or more loops.

REFERENCE SIGNS LIST

1 Exercise loops
2 First loop

3 Second loop
4 Third loop
5 Fourth loop
6 Fifth loop
2*b*, 4*b*, 5*b*, 6*b* Fastener

The invention claimed is:

1. Exercise loops comprising a first loop, a second loop, a third loop, a fourth loop and a fifth loop wherein the first through fifth loops respectively comprise first through fifth elastic elongated members each having opposing ends, wherein the first through fifth elastic elongated members are respectively formed by joining the respective opposing ends into respective ring shapes having inner circles thereinside, wherein:

the first loop, the third loop, the fourth loop and the fifth loop are each connected so as to be interlocked with the second loop such that the first, third, fourth and fifth loops pass through the inner circle of the second loop, and the second loop passes through the inner circles of the first, third, fourth and fifth loops, each of the first loop, the third loop, the fourth loop and the fifth loop comprises a fastener that binds two portions of one corresponding elastic elongated member of one corresponding loop such that the inner circle of the corresponding loop is divided into two circles with the fastener, and the fastener is movable along the corresponding elastic elongated member such that an engagement part where the corresponding loop is in contact with the second loop is secured by the fastener approaching the second loop, and the engagement part is loosened by the fastener, moving away from the second loop.

2. The exercise loops according to claim 1, wherein the first loop and the third loop are connected so as to be interlocked with each other such that the first passes through the inner circle of the third loop, and the third loop passes through the inner circle of the first loop.

3. The exercise loops according to claim 1, wherein a stretch resistance of the first elastic elongated member is different from a stretch resistance of the third elastic elongated member, and a stretch resistance of the fourth elastic elongated member is different from a stretch resistance of the fifth elastic elongated member.

4. The exercise loops according to claim 1, the fourth loop and the fifth loop are connected so as to be interlocked with each other such that the fourth loop passes through the inner circle of the fifth loop, and the fifth loop passes through the inner circle of the fourth loop.

5. The exercise loops according to claim 4, wherein a stretch resistance of the first elastic elongated member is different from a stretch resistance of the third elastic elongated member, and a stretch resistance of the fourth elastic elongated member is different from a stretch resistance of the fifth elastic elongated member.

6. The exercise loops according to claim 1, wherein a stretch resistance of the second elastic elongated member is the same as stretch resistances of the first and third elastic elongated members.

7. The exercise loops according to claim 1, wherein the first through third elastic elongated members have a same length.

8. Exercise loops comprising a first loop, a second loop, and a third loop wherein the first through third loops respectively comprise first through third elastic elongated members each having opposing ends, wherein the first through third elastic elongated members are respectively formed by joining the respective opposing ends into respective ring shapes having inner circles thereinside, wherein:

the first loop and the third loop are each connected so as to be interlocked with the second loop such that the first and third loops pass through the inner circle of the second loop, and the second loop passes through the inner circles of the first and third loops, each of the first loop and the third loop comprises a fastener that binds two portions of one corresponding elastic elongated member of one corresponding loop such that the inner circle of the corresponding loop is divided into two circles with the fastener, the fastener is movable along the corresponding elastic elongated member such that an engagement part where the corresponding loop is in contact with the second loop is secured by the fastener approaching the second loop, and the engagement part is loosened by the fastener moving away from the second loop, a stretch resistance of the second elastic elongated member is the same as stretch resistances of the first and third elastic elongated members, and the first through third elastic elongated members have a same length such that sizes of the first through third loops are identical.

* * * * *